US009249664B2

(12) United States Patent
Hori et al.

(10) Patent No.: US 9,249,664 B2
(45) Date of Patent: Feb. 2, 2016

(54) BENT AXIS TYPE AXIAL PISTON MOTOR

(71) Applicant: Komatsu Ltd., Tokyo (JP)

(72) Inventors: Takashi Hori, Oyama (JP); Teppei Asano, Oyama (JP); Masayuki Hosaka, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/880,809

(22) PCT Filed: Oct. 11, 2012

(86) PCT No.: PCT/JP2012/076308
§ 371 (c)(1),
(2) Date: Apr. 22, 2013

(87) PCT Pub. No.: WO2013/161099
PCT Pub. Date: Oct. 31, 2013

(65) Prior Publication Data

US 2015/0122116 A1 May 7, 2015

(30) Foreign Application Priority Data

Apr. 24, 2012 (JP) ..... 2012-098631

(51) Int. Cl.
*F01B 3/00* (2006.01)
*F03C 1/06* (2006.01)
*F03C 1/26* (2006.01)

(52) U.S. Cl.
CPC ..... *F01B 3/0038* (2013.01); *F01B 3/0041* (2013.01); *F01B 3/0067* (2013.01); *F03C 1/0642* (2013.01); *F03C 1/26* (2013.01)

(58) Field of Classification Search
CPC ..... F04B 1/2014; F03C 1/0678
USPC ..... 92/20, 57; 60/442
See application file for complete search history.

(56) References Cited

U.S. PATENT DOCUMENTS 3,618,467 A 11/1971 Faisandier et al.
4,271,725 A * 6/1981 Takao et al. ..... 475/83
(Continued)

FOREIGN PATENT DOCUMENTS

CN 201043556 Y 4/2008
CN 101195464 A 6/2008
(Continued)

OTHER PUBLICATIONS

Office Action dated Mar. 26, 2014, issued for the corresponding Chinese patent application No. 201280003383.7 and English translation thereof.
(Continued)

*Primary Examiner* — Edward Look
*Assistant Examiner* — Michael Quandt
(74) *Attorney, Agent, or Firm* — Locke Lord LLP

(57) ABSTRACT

In a bent axis type axial piston motor, so as to smoothly rotate a drive shaft without lowering motor efficiency and brake the drive shaft if necessary, when the drive shaft is rotated through a cylinder block by causing piston rods to reciprocate, relative rotation between separate plates and friction plates is allowed by removing a pressing force applied by a braking piston, and when the separate plates and the friction plates are pushed to a brake force receiving plate by the braking piston, relative rotation between the separate plates and the friction plates is restrained and thus the drive shaft is braked. Restriction members are disposed between a casing and the brake force receiving plate so as to restrain the brake force receiving plate from moving relative to the casing along the axis of the drive shaft.

6 Claims, 9 Drawing Sheets

(56) References Cited

U.S. PATENT DOCUMENTS

| | | | | |
|---|---|---|---|---|
| 4,565,117 | A * | 1/1986 | Forster | 92/20 |
| 4,951,551 | A * | 8/1990 | Arai et al. | 91/506 |
| 5,545,013 | A * | 8/1996 | Beck et al. | 417/201 |
| 6,260,653 | B1 | 7/2001 | Forster | |
| 6,405,835 | B1 * | 6/2002 | Satou et al. | 188/71.5 |

FOREIGN PATENT DOCUMENTS

| | | | |
|---|---|---|---|
| DE | 1928112 | | 12/1969 |
| DE | 4214397 | A1 | 11/1993 |
| DE | 19849334 | A1 | 4/2000 |
| EP | 0567736 | B1 | 11/1993 |
| GB | 2172677 | A | 9/1986 |
| JP | 61-6685 | U | 1/1986 |
| JP | 62-175271 | U | 11/1987 |
| JP | 03-081571 | A | 4/1991 |
| JP | 07-243376 | A | 9/1995 |
| JP | 07-310644 | A | 11/1995 |
| JP | 2003-090393 | A | 3/2003 |

OTHER PUBLICATIONS

Office Action dated Dec. 13, 2013, issued for the corresponding German patent application No. 112012001455.3 and English translation thereof.

International Search Report dated Jan. 8, 2013, issued for PCT/JP2012/076308 (in Japanese language).

* cited by examiner

BENT AXIS TYPE AXIAL PISTON MOTOR

FIELD

The present invention relates to a bent axis type axial piston motor, and more particularly, to a bent axis type axial piston motor in which a braking mechanism is disposed in a casing.

BACKGROUND

A bent axis type axial piston motor in which a braking mechanism is disposed in a casing is already proposed. The braking mechanism is disposed in an accommodation space formed in the casing outer circumference of an end part of a drive shaft, and the braking mechanism includes a plurality of friction plates and a plurality of separate plates. Each of the friction plates and the separate plates is an annular thin flat plate, and the friction plates and the separate plates are alternately arranged in a manner such that separate plates are disposed on both sides of the arrangement. The friction plates are movable along an axis of the drive shaft and are restrained from rotating relative to the drive shaft, and the separate plates are movable along the axis of the drive shaft and are restrained from rotating relative to the casing.

A braking piston is disposed at a position facing a side of the alternate arrangement of the friction plates and the separate plates, and a brake force receiving member is disposed at a position facing the other side of the alternate arrangement. The braking piston is movable along the axis of the drive shaft, and in a normal state, the braking piston is pushed toward the separate plate by a braking spring disposed between the braking piston and the casing. If hydraulic pressure is applied to the braking piston from a hydraulic circuit (not illustrated), the braking piston is moved away from the separate plate against the pressing force of the braking spring. The brake force receiving member has an annular shape and is disposed in the accommodation space between the casing and the separate plate, and when the braking piston is pushed toward the separate plate, the brake force receiving member restricts movement of the fiction plates and the separate plates to generate friction forces between the friction plates and the separate plates.

In the above-described bent axis type axial piston motor, if a pressing force applied by the braking piston is removed, relative rotation between the friction plates and the separate plates is allowed, and thus the drive shaft can be rotated relative to the casing. On the other hand, if the friction plates and the separate plates are pushed to the brake force receiving member by the braking piston, relative rotation between the friction plates and the separate plates is restrained owing to friction forces acting therebetween, and thus the drive shaft is restrained from rotating relative to the casing (See, for example, Patent Literature 1).

CITATION LIST

Patent Literature

Patent Literature 1: Japanese Patent Application Laid-open No. 2003-90393

SUMMARY

Technical Problem

However, in the above-described bent axis type axial piston motor, the position of the braking piston is limited to an outer circumferential region of a cylinder block. Therefore, the position of the friction plates and the separate plates to be pushed by the braking piston is limited to the end part of the drive shaft which is closest to the cylinder block.

In the bent axis type axial piston motor, the drive shaft and the cylinder block the axes of which cross at an oblique angle are slidably connected through a center shaft and a plurality of piston rods, and the drive shaft and the cylinder block rotate on their axes, respectively. Therefore, generally, the drive shaft is supported on the casing using a taper roller bearing. It is preferable that the position where the drive shaft is supported by the taper roller bearing is closest to the cylinder block. However, if the taper roller bearing is disposed close to the accommodation space in which the plurality of friction plates and the plurality of separate plates are disposed, rotational resistance may increase to lower motor efficiency.

After carrying out experiments and studies to find out the reason of motor efficiency reduction, it has been found out that when the drive shaft rotates, a jet flow of oil from the taper roller bearing collides with the brake force receiving member disposed between the accommodation space and the taper roller bearing. That is, if a jet flow of oil from the taper roller bearing collides with the brake force receiving member, the brake force receiving member is moved toward the braking piston, and thus gaps between the separate plates and the friction plates are decreased or brought into contact with each other, thereby increasing rotational resistance between the separate plates and the friction plates and lowering motor efficiency.

Accordingly, an object of the present invention is to provide a bent axis type axial piston motor in which a drive shaft can be smoothly rotated without lowering motor efficiency and be braked if necessary.

Solution to Problem

In order to achieve the above object, there is provided a bent axis type axial piston motor according to the present invention including: a drive shaft supported by a casing through a taper roller bearing disposed between the drive shaft and the casing, the drive shaft being supported in a manner such that an end part of the drive shaft is disposed in the casing and the drive shaft is rotatable on an axis thereof; a cylinder block slidably connected to the end part of the drive shaft through a center shaft and a plurality of piston rods disposed around the center shaft, the cylinder block being disposed in the casing in a manner such that the cylinder block is rotatable around an axis of the center shaft; an accommodation space formed in the casing at a position close to a roller accommodation part of the taper roller bearing and surrounding the end part of the drive shaft; a plurality of first braking elements having an annular flat plate shape and disposed in the accommodation space in a manner such that the first braking elements are movable along the axis of the drive shaft but are restrained from rotating relative to the casing; a plurality of second braking elements having an annular flat plate shape and disposed in the accommodation space in a manner such that the second braking elements are movable along the axis of the drive shaft but are restrained from rotating relative to the drive shaft, the second braking elements and the first braking elements being alternately arranged in the accommodation space; a brake force receiving member having an annular shape and disposed in the accommodation space at a position facing the roller accommodation part of the taper roller bearing; and a braking member movably disposed at a position facing the brake force receiving member with the alternately arranged first and second braking elements disposed between the braking member and the brake force receiving member, so as to cause frictional forces between the first and second braking elements by pushing the first and second braking elements against the brake force receiving member, wherein when the drive shaft is rotated using the cylinder block by causing the piston rods to reciprocate, a pressing force applied by the braking member is removed to allow relative rotation between the first and second braking elements, and when the first and second braking elements are pushed against the brake force receiving member by the braking member, relative rotation between the first and second braking elements is restrained so as to brake the drive shaft, wherein a restriction member is disposed between the casing and the brake force receiving member to restrain the brake force receiving member from moving relative to the casing along the axis of the drive shaft.

In the bent axis type axial piston motor according to the present invention, it is characterized that the restriction member has a plate shape and is attached to an end surface of the brake force receiving member in a state where an outer circumferential part of the restriction member protrudes from an outer circumferential part of the brake force receiving member, and an internal engagement groove is formed in the casing to receive an end part of the restriction member protruding from the outer circumferential part of the brake force receiving member.

In the bent axis type axial piston motor according to the present invention, it is characterized that the restriction member has a small fragment shape and is provided in plurality, and the restriction members are arranged such that the restriction members protrude from a plurality of positions of the outer circumferential part of the brake force receiving member.

In the bent axis type axial piston motor according to the present invention, it is characterized that the restriction members have holes long in radial directions of the brake force receiving member and are attached to the end surface of the brake force receiving member by securing fixing screw members to the brake force receiving member through the long holes, and the restriction members are extendable or retractable from the outer circumferential part of the brake force receiving member by varying positions of the fixing screw members in the long holes.

In the bent axis type axial piston motor according to the present invention, it is characterized that an external engagement groove is formed in an outer circumferential part of the brake force receiving member, an internal engagement groove is formed in the casing at a position facing the external engagement groove of the brake force receiving member, and the restriction member is disposed between the external engagement groove of the brake force receiving member and the internal engagement groove of the casing.

In the bent axis type axial piston motor according to the present invention, it is characterized that the restriction member is an elastic linear member, and if the restriction member is elastically deformed by an external force, the restriction member is accommodated in the external engagement groove of the brake force receiving member, and if the external force is removed, at least a part of the restriction member protrudes outward from the external engagement groove of the brake force receiving member.

Advantageous Effects of Invention

According to the present invention, although the taper roller bearing is disposed close to the accommodation space of the casing, the brake force receiving member disposed between the accommodation space and the roller accommodation part of the taper roller bearing is restrained from moving along the axis of the drive shaft by the restriction member disposed between the brake force receiving member and the casing. Therefore, although a jet flow of oil from the taper roller bearing collides with the brake force receiving member when the drive shaft rotates, gaps between the first braking elements and the second braking elements are not reduced, and thus rotation resistance between the first braking elements and the second braking elements is not increased. As a result, it is possible to provide a bent axis type axial piston motor in which a drive shaft can be smoothly rotated without lowering motor efficiency and be braked if necessary.

DESCRIPTION OF EMBODIMENTS

Hereinafter, preferable embodiments of a bent axis type axial piston motor of the present invention will be described in detail.

(First Embodiment)

Figure 1:
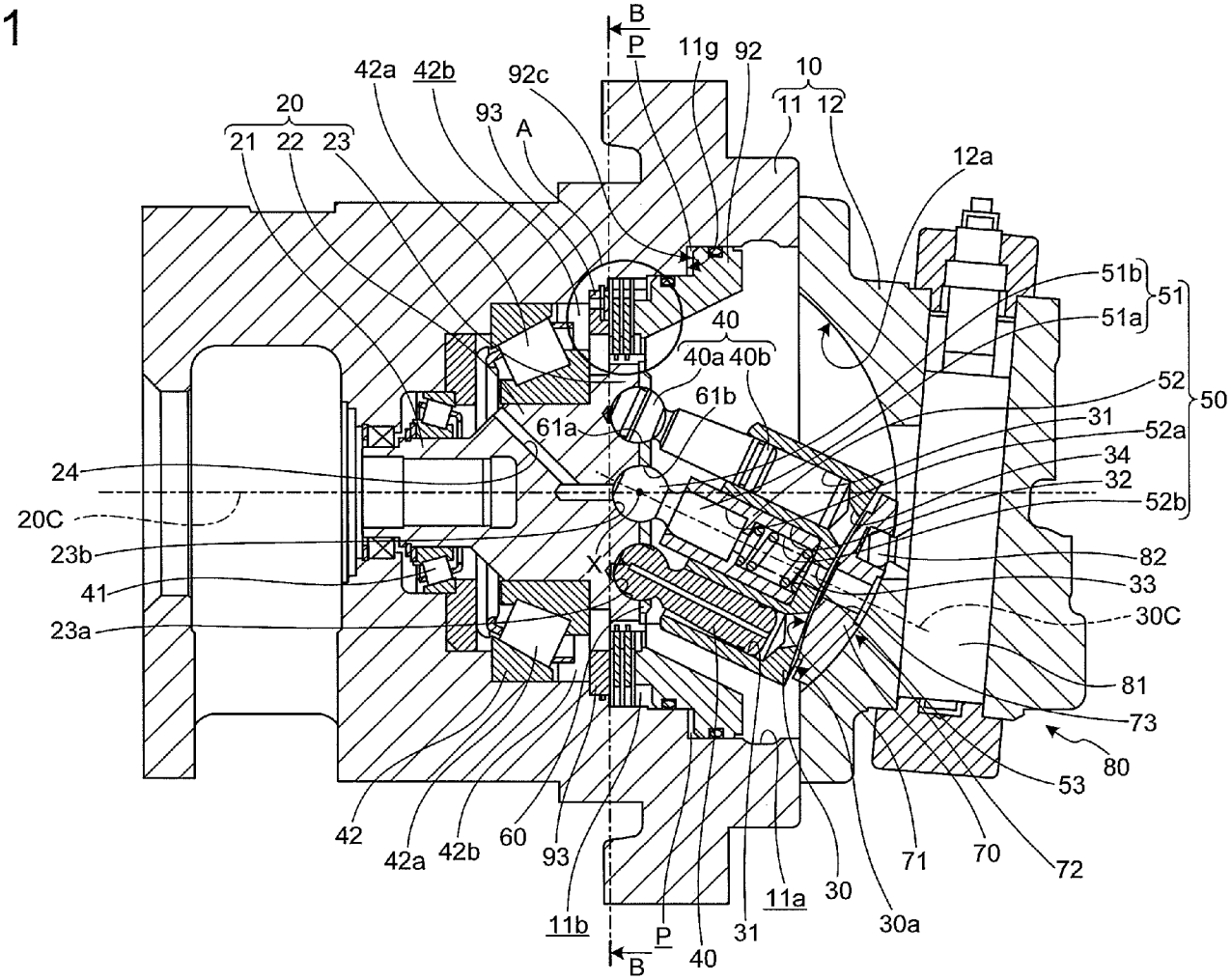
FIG. 1 is a side cross-sectional view illustrating a bent axis type axial piston motor according to a first embodiment of the present invention.
Figure 2:
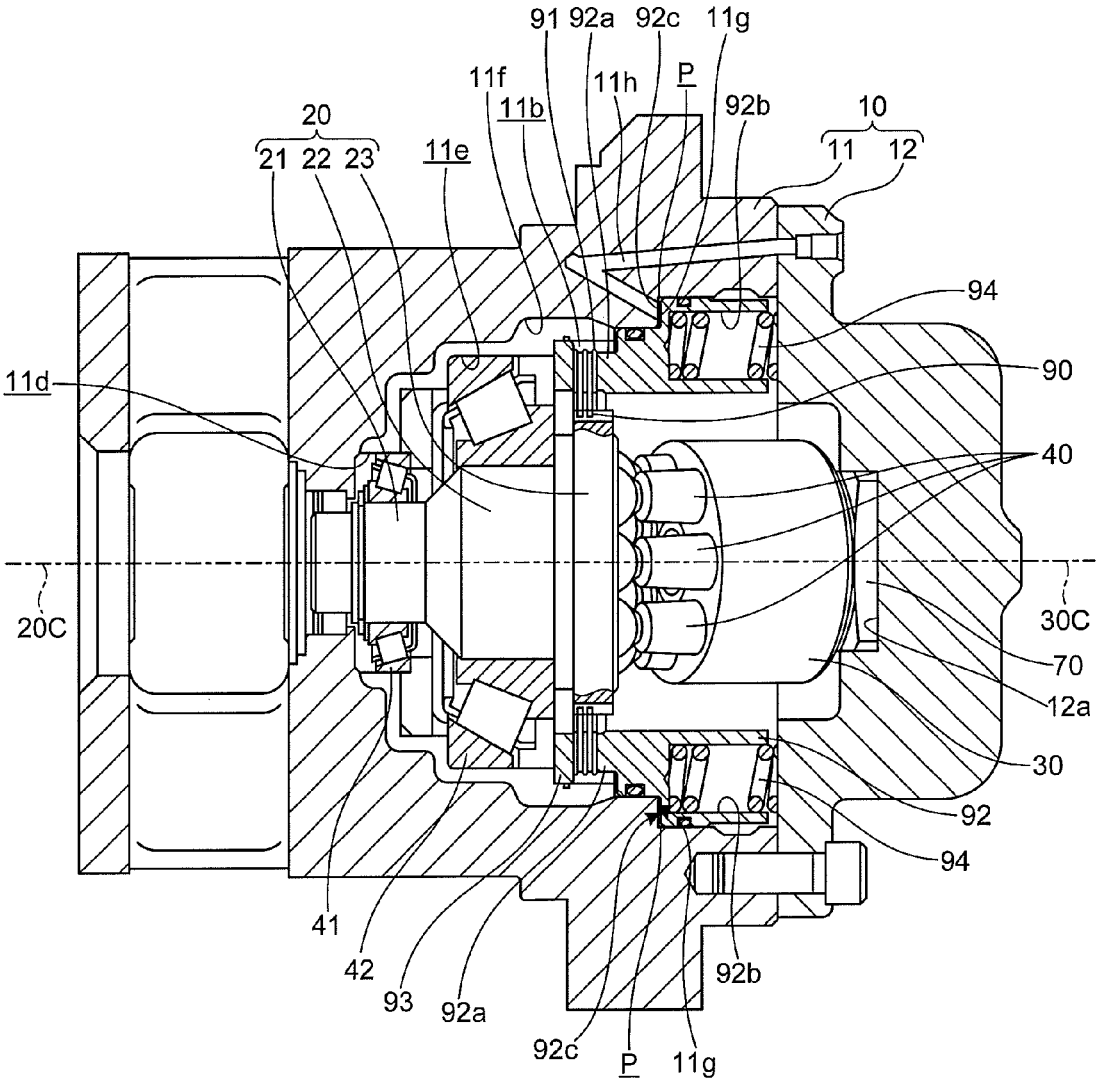
FIG. 2 is a horizontal cross-sectional view of the bent axis type axial piston motor illustrated in FIG. 1.
Figure 3:
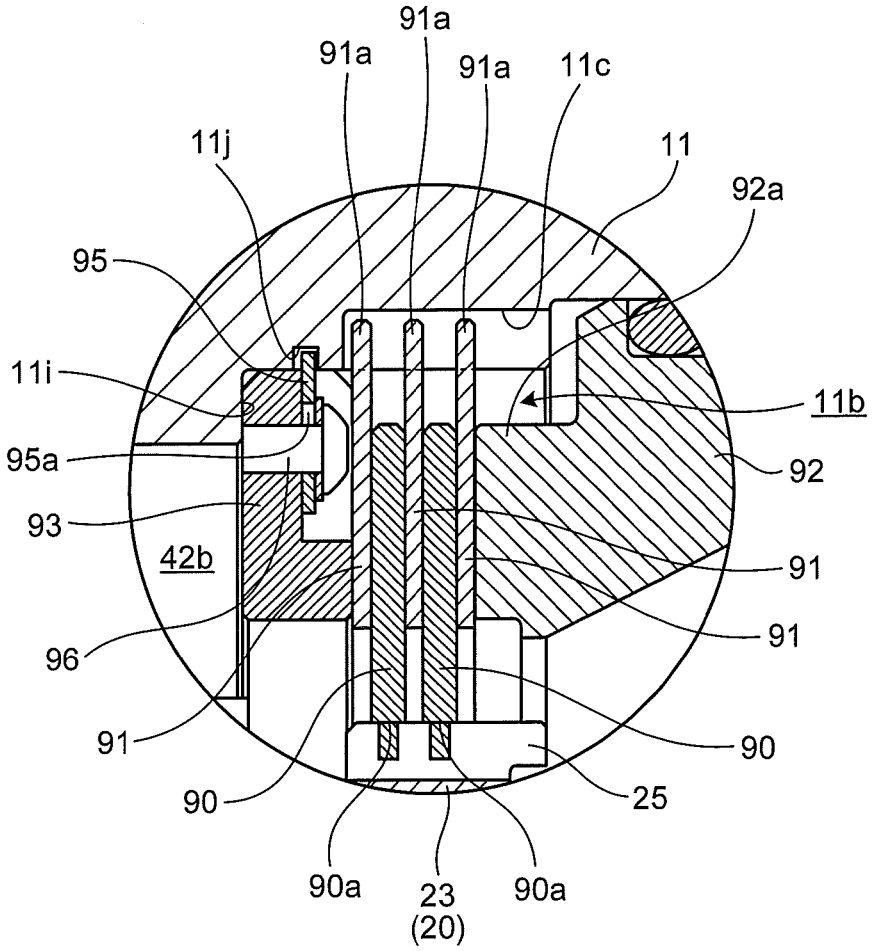
FIG. 3 is an enlarged side cross-sectional view of portion (A) of FIG. 1.

FIGS. 1 to 3 illustrate a bent axis type axial piston motor according to a first embodiment of the present invention. The illustrated bent axis type axial piston motor is used as a hydraulic drive motor in a construction machine vehicle such as an excavator and a bulldozer, and the bent axis type axial piston motor includes a casing 10. The casing 10 includes a hollow casing main body 11 having an opened end, and a guide plate 12 attached to the opened end of the casing main body 11 to close the opened end. In the casing 10, a drive shaft 20 and a cylinder block 30 are placed in a hollow inside 11*a* of the casing main body 11.

The drive shaft 20 includes a first bearing support part 21 having a cylindrical shape, a second bearing support part 22 having a relatively large diameter and formed on an end of the first bearing support part 21, and a circular-plate-shaped disk part 23 having a relatively large diameter and formed on an end of the second bearing support part 22. In a state where the disk part 23 is placed in the hollow inside 11*a* of the casing main body 11, the first bearing support part 21 and the second bearing support part 22 of the drive shaft 20 are supported by the casing main body 11. More specifically, a first taper roller bearing 41 is provided between the first bearing support part 21 of the drive shaft 20 and the casing main body 11, and a second taper roller bearing 42 is provided between the second bearing support part 22 of the drive shaft 20 and the casing main body 11, such that the drive shaft 20 can be rotated relative to the casing main body 11 around the axis of the drive shaft 20. The second taper roller bearing 42 is larger than the first taper roller bearing 41 and is placed between the drive shaft 20 and the casing main body 11 in a state where large-diameter parts of taper rollers 42*a* face the hollow inside 11*a* of the casing main body 11.

A plurality of rod support parts 23*a* and a shaft support part 23*b* are provided in an end surface of the disk part 23 of the drive shaft 20. Each of the rod support parts 23*a* and the shaft support part 23*b* has an approximately semispherical concave shape formed in the end surface of the disk part 23. The rod support parts 23*a* are provided at seven positions evenly spaced along the circumference of a circle centered on the axis 20C of the drive shaft 20, so as to support piston rods 40, respectively. The shaft support part 23*b* is formed at a position of the disk part 23 aligned with the axis 20C of the drive shaft 20 so as to support a center shaft 50. In addition, a relief passage 24 is formed in the inside of the shaft support part 23*b*. The relief passage 24 extends from the shaft support part 23*b* along the axis 20C of the drive shaft 20, and then toward the other end side with a gradual outward slope, so as to be opened at an outer circumferential surface position of the drive shaft 20 located between the first bearing support part 21 and the second bearing support part 22.

The piston rods 40 taper in a manner such that the outer diameter thereof gradually increases from a base end to a tip end, and each of the piston rods 40 has a support ball head part 40*a* on the base end thereof and a piston part 40*b* on the tip end thereof. The support ball head parts 40*a* of the piston rods 40 have a spherical shape with an appropriate outer diameter such that the support ball head parts 40*a* can be slidably inserted in the rod support parts 23*a* of the disk part 23 of the drive shaft 20. The support ball head parts 40*a* of the piston rods 40 have an outer diameter greater than that of the piston parts 40*b*.

The center shaft 50 includes an inner shaft 51 and an outer race 52. The inner shaft 51 has a cylindrical shaft base part 51*a* and a shaft support ball head part 51*b* provided on a base end of the shaft base part 51*a*. The shaft support ball head part 51*b* of the inner shaft 51 has a spherical shape with an appropriate outer diameter such that shaft support ball head part 51*b* can be slidably inserted in the shaft support part 23*b* of the disk part 23 of the drive shaft 20. The shaft base part 51*a* has an outer diameter smaller than that of the shaft support ball head part 51*b*. Although not clearly illustrated in the drawings, an oil passage is provided in the inner shaft 51 from an end surface of the shaft base part 51*a* to an apex part of the shaft support ball head part 51*b*.

The outer race 52 is cylindrically shaped and has a shaft part accommodation hole 52*a* and a spring accommodation hole 52*b* along an axis thereof. The shaft part accommodation hole 52*a* is a cavity formed in an end surface of the outer race 52 and having a circular cross-sectional shape. The inner diameter of the shaft part accommodation hole 52*a* is set such that the shaft base part 51*a* of the inner shaft 51 can be fit to the shaft part accommodation hole 52*a* without shaking. The spring accommodation hole 52*b* is a cavity formed in the other end surface of the outer race 52. The spring accommodation hole 52*b* has a circular cross-sectional shape, and a pressure spring 53 is accommodated in the spring accommodation hole 52*b*. The pressure spring 53 is a coil spring having an outer diameter slightly smaller than the inner diameter of the spring accommodation hole 52*b* and a no-load length greater than the length of the spring accommodation hole 52*b*.

After the ball head parts 40*a* and 51*b* are fitted to the rod support parts 23*a* or the shaft support part 23*b* formed in the disk part 23 of the drive shaft 20, a retainer plate 60 is fixed to the end surface of the disk part 23, so that the plurality of piston rods 40 and the center shaft 50 can be tiltably supported on the end surface of the disk part 23 in a state where the ball head parts 40*a* and 51*a* are kept from moving away from the end surface of the disk part 23. The retainer plate 60 is a plate member having rod insertion holes 61*a* at positions facing the rod support parts 23*a* of the disk part 23 and a shaft insertion hole 61*b* at a position facing the shaft support part 23*b*. The rod insertion holes 61*a* have an inner diameter smaller than the support ball head parts 40*a* of the piston rods 40, and the shaft insertion hole 61*b* has an inner diameter smaller than the shaft support ball head part 51*b* of the center shaft 50. After the piston rods 40 are inserted in the rod insertion holes 61*a* and the center shaft 50 is inserted in the shaft insertion hole 61*b*, the retainer plate 60 is attached to the end surface of the disk part 23.

The cylinder block 30 is a cylindrical member with a circular cross-sectional shape, and has a plurality of cylinder bores 31 and a shaft fitting hole 32. Each of the cylinder bores 31 and the shaft fitting hole 32 is a cavity formed along an axis 30C of the cylinder block 30. The cylinder bores 31 and the shaft fitting hole 32 have the same circular cross-sectional shape and are opened at an end surface of the cylinder block 30. Although not clearly illustrated in the drawings, the cylinder bores 31 are arranged at seven regularly spaced positions along the circumference of a circle centered on the axis 30C of the cylinder block 30. The circle along which the cylinder bores 31 are arranged has the same size as that of the circle along which the rod support parts 23*a* are arranged on the disk part 23 of the drive shaft 20. The piston parts 40*b* of the piston rods 40 are accommodated in the cylinder bores 31, respectively, in a manner such that the piston parts 40*b* can reciprocate therein. The shaft fitting hole 32 is formed at a position aligned with the axis 30C of the cylinder block 30. The outer race 52 of the center shaft 50 is fitted to the shaft fitting hole 32 without shaking. As clearly illustrated in the drawings, the outer race 52 has an axial length greater than the length of the shaft fitting hole 32, and thus a part of the outer race 52 protrudes from the end surface of the cylinder block 30.

The end surface of the cylinder block 30 in which the shaft fitting hole 32 and the cylinder bores 31 are formed is a flat surface perpendicular to the axis of the cylinder block 30, and the other surface of the cylinder block 30 is a concave surface 30*a*. Although not clearly illustrated in the drawings, the concave surface 30*a* of the cylinder block 30 has a partial sphere shape the center of which is on the axis 30C of the cylinder block 30. A communication hole 33 and a plurality of connection passages 34 are formed in the concave surface 30*a* of the cylinder block 30. The communication hole 33 is an opening formed at a position aligned with the axis 30C of the cylinder block 30 to communicate with the shaft fitting hole 32. The inner diameter of the communication hole 33 is smaller than that of the shaft fitting hole 32. Although not clearly illustrated in the drawings, the connection passages 34 are openings arranged at seven regularly spaced positions along the circumference of a circle centered on the axis 30C of the cylinder block 30. The circle along with the connection passages 34 are arranged has a radius smaller than that of the circle along which the cylinder bores 31 are arranged. The connection passages 34 have an inner diameter smaller than that of the cylinder bores 31 and are connected to the cylinder bores 31, respectively.

A valve plate 70 is disposed between the concave surface 30*a* of the cylinder block 30 and the guide plate 12 of the casing 10. The valve plate 70 has a slidable convex sphere surface 71 and a slidable convex cylinder surface 72, and the slidable convex sphere surface 71 is slidably in contact with the concave surface 30*a* of the cylinder block 30, and the slidable convex cylinder surface 72 is slidably in contact with a guide surface 12*a* of the guide plate 12. The slidable convex sphere surface 71 protrudes in a spherical shape having the same radius of curvature as that of the concave surface 30*a* of the cylinder block 30, such that the slidable convex sphere surface 71 can slide in a state where the slidable convex sphere surface 71 is entirely in close contact with the concave surface 30*a* of the cylinder block 30. The slidable convex cylinder surface 72 is a convex cylindrical surface protruding in a direction opposite to the slidable convex sphere surface 71.

The guide surface 12*a* of the guide plate 12 making contact with the slidable convex cylinder surface 72 is a concave cylindrical surface having the same radius of curvature as that of the slidable convex cylinder surface 72 but an arc length greater than that of the slidable convex cylinder surface 72, and the guide surface 12*a* faces the disk part 23 of the drive shaft 20. The guide surface 12*a* of the guide plate 12 is positioned such that the center axis of the cylindrical guide surface 12*a* passes through a center X of the shaft support part 23*b* of the disk part 23 of the drive shaft 20 in a direction perpendicular to the axis 20C of the drive shaft 20.

In addition, reference numeral 80 denotes an actuator for moving the valve plate 70 along the guide surface 12*a* of the guide plate 12. An actuator piston 81 of the actuator 80 functioning as an output part is tiltably connected to the valve plate 70 through a connection pin 82.

Although not clearly illustrated in the drawings, a high-pressure port and a low-pressure port are formed in the slidable convex sphere surface 71 of the valve plate 70 at positions corresponding to the connection passages 34 of the cylinder block 30. For example, if the cylinder block 30 is divided into two sides by an imaginary plane containing the axis 20C of the drive shaft 20 and the axis 30C of the cylinder block 30, the high-pressure port communicates with a plurality of cylinder bores 31 positioned in one side, and the low-pressure port communicates with the other cylinder bores 31 positioned in the other side. In addition, reference numeral 73 denotes a communication passage formed from the slidable convex sphere surface 71 to the slidable convex cylinder surface 72 of the valve plate 70. The communication passage 73 is formed in the slidable convex sphere surface 71 at a position aligned with the axis 30C of the cylinder block 30.

Figure 5:
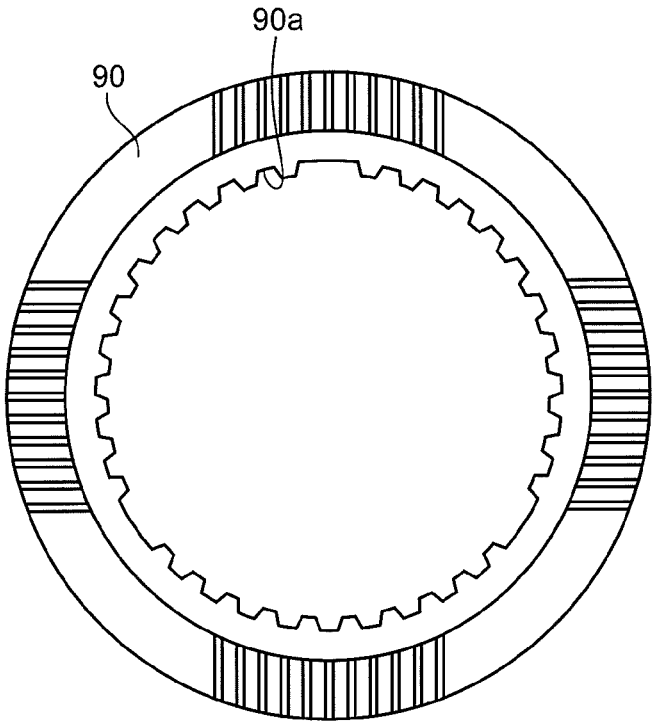
FIG. 5 is a view illustrating a friction plate applied to the bent axis type axial piston motor of FIG. 1.
Figure 6:
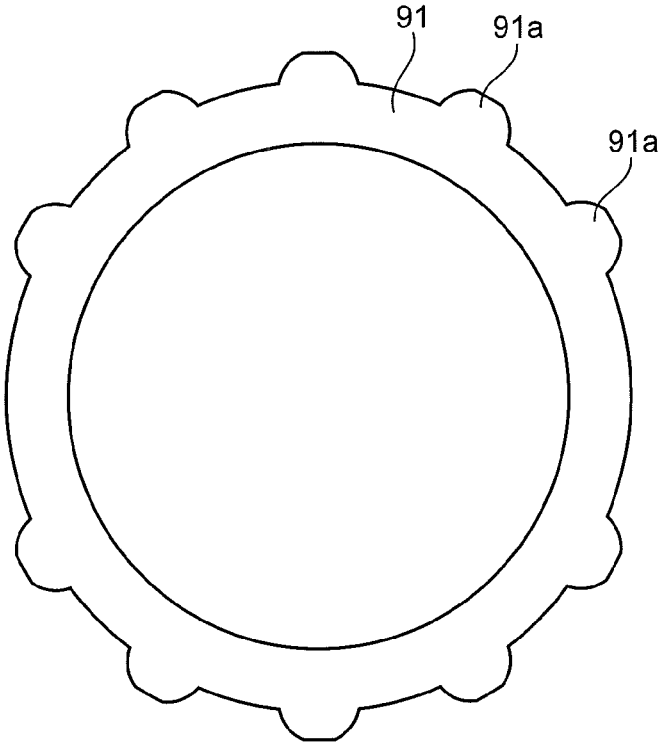
FIG. 6 is a view illustrating a separate plate applied to the bent axis type axial piston motor of FIG. 1.

In the bent axis type axial piston motor, an accommodation space 11*b* is formed in the hollow inside 11*a* of the casing 10 to accommodate the plurality of friction plates (second braking elements) 90 and a plurality of separate plates (first braking elements) 91. The accommodation space 11*b* is an annual cavity formed around the disk part 23 at a position close to a roller accommodation part 42*b* of the second taper roller bearing 42. The friction plates 90 and the separate plates 91 have a circular ring shape and are alternately arranged along the axis 20C of the drive shaft 20 in a manner such that separate plates 91 are positioned on both sides of the arrangement. The friction plates 90 have an outer diameter smaller than the diameter of the inner circumferential surface of the casing 10, and as illustrated in FIG. 5, spline grooves 90*a* are formed along the inner circumferences of the friction plates 90. The separate plates 91 have an inner diameter greater than splines 25 of the disk part 23, and as illustrated in FIG. 6, a plurality of arc-shaped protrusions 91*a* are formed along the outer circumferences of the separate plates 91.

As illustrated in FIG. 3, a plurality of arc-shaped groove parts 11*c* are formed in an inner circumferential surface of the casing main body 11 facing the accommodation space 11*b*, and the splines 25 are formed on an outer circumferential surface of the disk part 23 of the drive shaft 20 facing the accommodation space 11*b*. Although not clearly illustrated in the drawings, the arc-shaped groove parts 11*c* are concave parts for engagement with the arc-shaped protrusions 91*a* of the separate plates 91, and the arc-shaped groove parts 11*c* are opened toward the accommodation space 11*b* and arranged at regular intervals. The splines 25 are provided for engagement with the spline grooves 90*a* of the friction plates 90, and for this, the splines 25 are formed on the outer circumferential surface of the disk part 23 at positions facing the arc-shaped groove parts 11*c* of the casing 10. In addition, reference numeral 11*f* of FIG. 2 denotes a pair of connection passages for connecting the accommodation space 11*b* to a space 11*d* of the casing main body 11 in which the first taper roller bearing 41 is accommodated and a space 11*e* of the casing main body 11 in which the second taper roller bearing 42 is accommodated. In the first embodiment, the connection passages 11*f* are spaced 180 degrees apart from each other.

As illustrated in FIGS. 1 to 3, the spline grooves 90*a* formed in the inner circumferential surfaces of the friction plates 90 accommodated in the accommodation space 11*b* are engaged with the splines 25 of the drive shaft 20, and thus the friction plates 90 are allowed to move relative to the drive shaft 20 along the axis of the drive shaft 20 but are not allowed to rotate relative to the drive shaft 20. The arc-shaped protrusions 91*a* formed on the outer circumferential surfaces of the separate plates 91 are engaged with the arc-shaped groove parts 11*c* of the casing 10, and thus the separate plates 91 are allowed to move relative to the casing 10 along the axis 20C of the drive shaft 20 but are not allowed to rotate relative to the casing 10.

The friction plates 90 and the separate plates 91 are disposed between a braking piston (braking member) 92 and a brake force receiving plate (brake force receiving member) 93 that face each other. As illustrated in FIGS. 1 and 2, the braking piston 92 is a cylindrical part disposed on the inner circumferential surface of the casing main body 11 around the cylinder block 30, and the braking piston 92 is slidable relative to the casing main body 11 along the axis 20C of the drive shaft 20. A pressure chamber P is formed between the braking piston 92 and the casing 10, and the braking piston 92 includes a pressing part 92*a* formed on an end part thereof and a pair of braking spring chambers 92*b* formed in the other end part thereof. The pressure chamber P is an annular space formed between a movable pressure receiving surface 92*c* of the braking piston 92 perpendicular to the axis 20C of the drive shaft 20 and a fixed pressure receiving surface 11*g* of the casing 10 facing the movable pressure receiving surface 92*c* of the braking piston 92. An oil supply passage 11*h* is communicated to the pressure chamber P from a hydraulic power supply source (not illustrated). The pressing part 92*a* is a protrusion aligned with parts of the separate plates 91 disposed in the accommodation space 11*b* and overlapped with the friction plates 90, and the pressing part 92*a* can be brought into contact with the separate plate 91 without making contact with the splines 25 of the drive shaft 20 and the casing 10. The braking spring chambers 92*b* are cavities formed along the axis 20C of the drive shaft 20. The braking spring chambers 92*b* have a circular cross-sectional shape and accommodate braking springs 94, respectively. The braking springs 94 are coil springs disposed between the braking piston 92 and the guide plate 12. The braking springs 94 are placed in the braking spring chambers 92*b* in a compressed condition so that the movable pressure receiving surface 92*c* and the fixed pressure receiving surface 11*g* of the pressure chamber P can be normally in a closely spaced condition.

The brake force receiving plate 93 is a thick annular plate disposed in the accommodation space 11*b* at a position facing the roller accommodation part 42*b* of the second taper roller bearing 42. A surface of the brake force receiving plate 93 facing the second taper roller bearing 42 is in contact with a step part 11*i* formed on the casing main body 11, and thus the brake force receiving plate 93 is restrained from moving toward the second taper roller bearing 42. On the other hand, the other surface of the brake force receiving plate 93 facing the accommodation space 11*b* faces parts of the separate plates 91 overlapped with the friction plates 90, such that when the movable pressure receiving surface 92*c* of the braking piston 92 is moved close to the fixed pressure receiving surface 11*g* of the casing 10, the friction plates 90 and the separate plates 91 can be kept between the brake force receiving plate 93 and the pressing part 92*a* of the braking piston 92 in a mutually pressing state owing to pressing forces of the braking springs 94.

Figure 4:
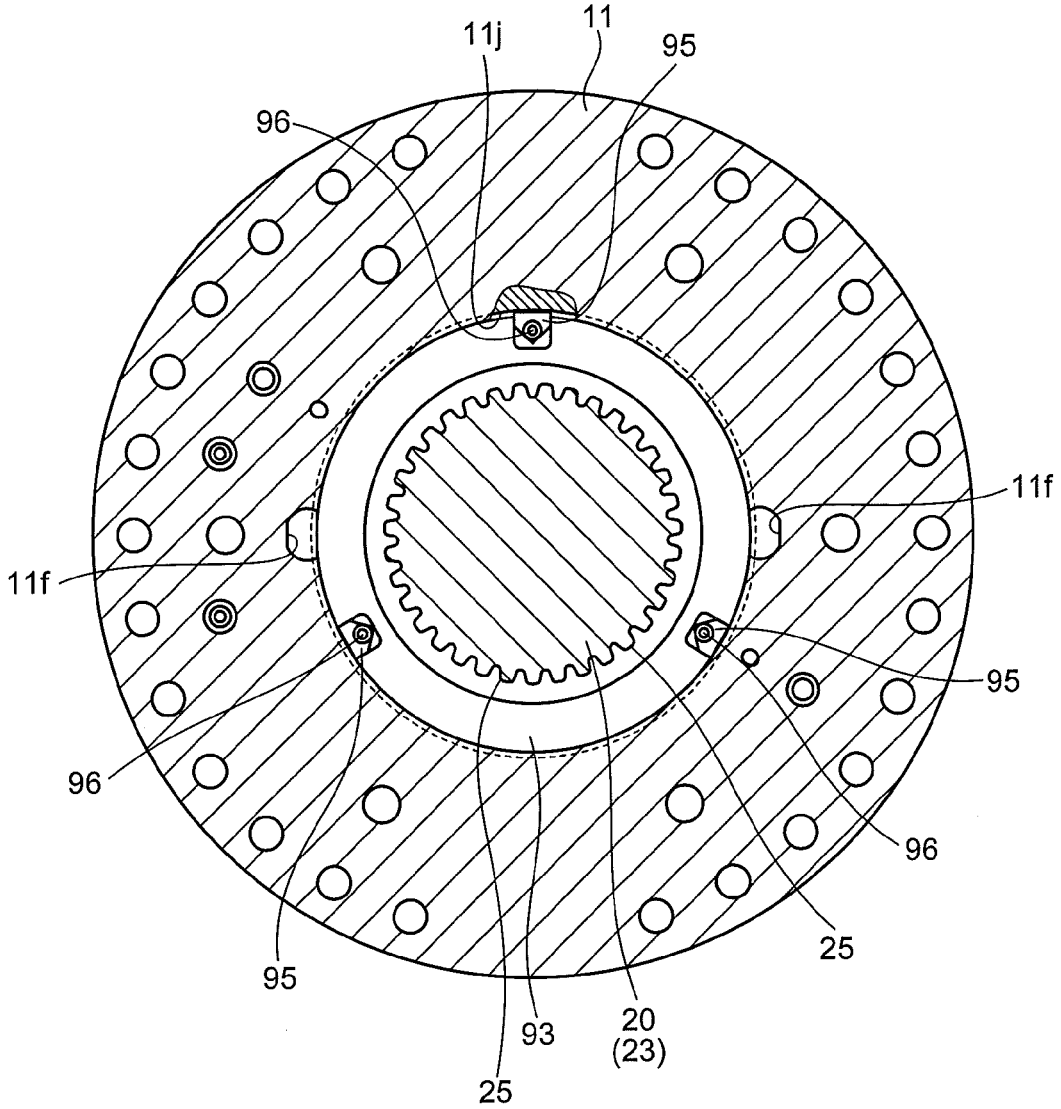
FIG. 4 is a cross-sectional view taken along line B-B in FIG. 1.

As illustrated in FIGS. 3 and 4, an internal engagement groove 11*j* is formed in an inner circumferential surface of the accommodation space 11*b* of the casing main body 11, and restriction members 95 are provided at a plurality of positions of the brake force receiving plate 93. The internal engagement groove 11*j* is a narrow groove surrounding the outer circumferential surface of the brake force receiving plate 93 and is formed along the entire inner circumferential surface of the accommodation space 11*b*. The restriction members 95 are small thin plate fragments each insertable into the internal engagement groove 11*j* and are attached to the brake force receiving plate 93 by securing fixing screw members 96 to an end surface of the brake force receiving plate 93 through long holes 95*a* formed in base parts of the restriction members 95. Each of the restriction members 95 can be set to protrude or retract from the outer circumferential surface of the brake force receiving plate 93 by varying the position of the long hole 95*a* relative to the fixing screw member 96. In the first embodiment, as illustrated in FIG. 4, the restriction members 95 are attached to three regularly spaced positions. In a state where the restriction members 95 retract from the outer circumferential surface of the brake force receiving plate 93, the brake force receiving plate 93 is placed in the accommodation space 11*b*, and then the restriction members 95 are pushed to protrude from the outer circumferential surface of the brake force receiving plate 93 and the fixing screw members 96 are secured, thereby placing tip ends of the restriction members 95 in the internal engagement groove 11*j*. Since the restriction members 95 are placed in the internal engagement groove 11*j* of the casing main body 11, that is, the restriction members 95 are engaged with the casing main body 11 through the internal engagement groove 11*j*, the brake force receiving plate 93 are restrained from moving along the axis 20C of the drive shaft 20 but allowed to rotate around the axis 20C of the drive shaft 20.

In the above-described bent axis type axial piston motor, owing to the center shaft 50 and the plurality of piston rods 40 disposed between the disk part 23 of the drive shaft 20 and the cylinder block 30, the drive shaft 20 and the cylinder block 30 can be slidably connected with axes thereof crossing, and the cylinder block 30 can be rotated on the axis of the center shaft 50, that is, on the axis 30C of the cylinder block 30. Although not clearly illustrated in the drawings, oil is filled in the hollow inside 11*a* of the casing main body 11.

As illustrated in FIGS. 1 and 2, when hydraulic pressure is not applied to the pressure chamber P, owing to the pressing forces of the braking springs 94, the movable pressure receiving surface 92*c* and the fixed pressure receiving surface 11*g* are kept close to each other. Therefore, the friction plates 90 and the separate plates 91 disposed between the pressing part 92*a* of the braking piston 92 and the brake force receiving plate 93 are kept in a mutually pressing state, and thus the drive shaft 20 is restrained from rotating relative to the casing 10.

In this state, if hydraulic pressure is applied to the pressure chamber P to increase the gap between the movable pressure receiving surface 92*c* and the fixed pressure receiving surface 11*g* against the pressing forces of the braking springs 94, pressing forces acting between the friction plates 90 and the separate plates 91 are removed, and thus the friction plates 90 and the separate plates 91 can be rotated relative to each other, that is, the drive shaft 20 can be rotated relative to the casing 10. Therefore, if the low-pressure port is connected to an oil tank while supplying oil to the high-pressure port, piston rods 40 disposed in cylinder bores 31 connected to the high-pressure port are gradually moved toward the drive shaft 20, and piston rods 40 disposed in cylinder bores 31 connected to the low-pressure port gradually retract, so that the cylinder block 30 can be rotated and thus the bent axis type axial piston motor can function while using the drive shaft 20 as an output shaft. If the position of the valve plate 70 is varied on the guide surface 12*a* of the guide plate 12 by operating the actuator 80, the angle between the drive shaft 20 and the cylinder block 30 can be varied, and thus displacements of the piston rods 40 in the cylinder bores 31 can be varied, that is, capacity can be varied.

When the drive shaft 20 is rotated relative to the casing 10, if hydraulic pressure applied to the pressure chamber P is removed, due to the pressing forces of the braking springs 94, the friction plates 90 and the separate plates 91 disposed between the braking piston 92 and the brake force receiving plate 93 are pressed, the drive shaft 20 rotating relative to the casing 10 is braked.

In the bent axis type axial piston motor, since the second taper roller bearing 42 is disposed close to the accommodation space 11*b* of the casing 10, the drive shaft 20 can be smoothly rotated. In addition, since the restriction members 95 are disposed in the internal engagement groove 11*j* of the casing 10, the brake force receiving plate 93 disposed between the accommodation space 11*b* and the roller accommodation part 42*b* of the second taper roller bearing 42 can be restrained from moving along the axis 20C of the drive shaft 20. Therefore, although a jet flow of oil from the second taper roller bearing 42 collides with the brake force receiving plate 93 when the drive shaft 20 is rotated, gaps between the friction plates 90 and the separate plates 91 are not decreased, and thus rotational resistance between the friction plates 90 and the separate plates 91 is not increased. As a result, the drive shaft 20 can be smoothly rotated without lowering motor efficiency, and if necessary the drive shaft 20 can be braked.

In the first embodiment, since three restriction members 95 are provided for two connection passages 11*f*, although the brake force receiving plate 93 is placed at any position relative to the casing 10, the two connection passages 11*f* are not simultaneously closed by the restriction members 95, and thus hydraulic pressure may not be undesirably increased in the casing 10. However, the number of restriction members 95 is not limited to three. Two or more restriction members 95 may be preferable.

(Second Embodiment)

Figure 7:
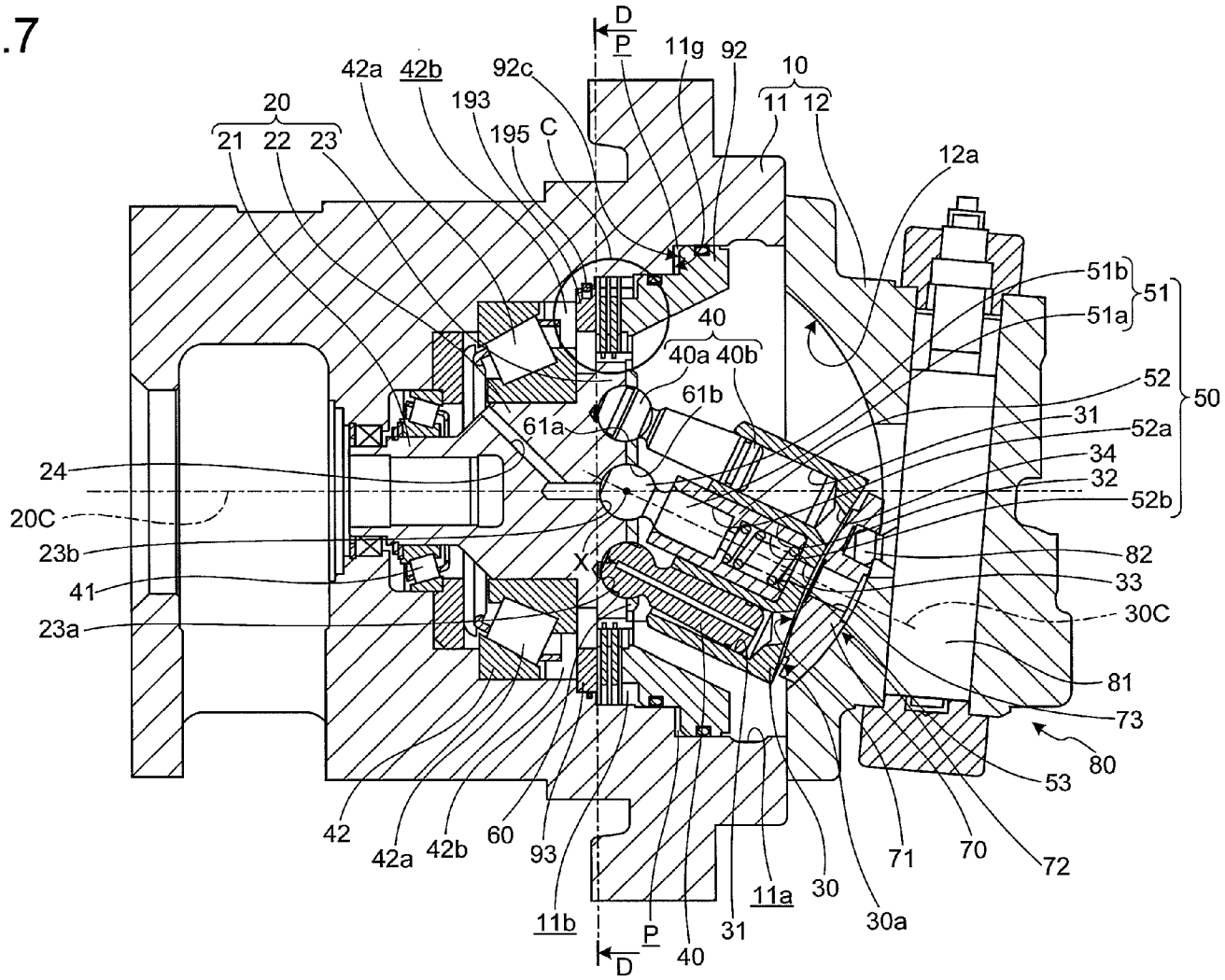
FIG. 7 is a side cross-sectional view illustrating a bent axis type axial piston motor according to a second embodiment of the present invention.
Figure 8:
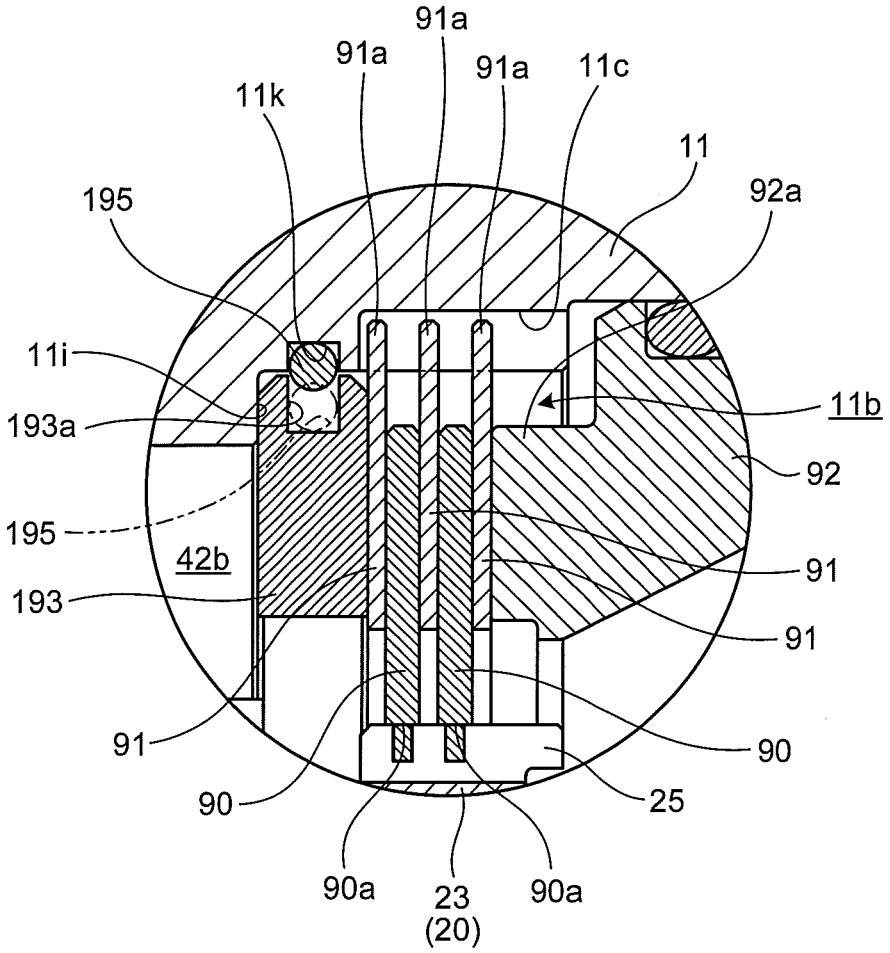
FIG. 8 is an enlarged side cross-sectional view of portion (C) of FIG. 7.
Figure 9:
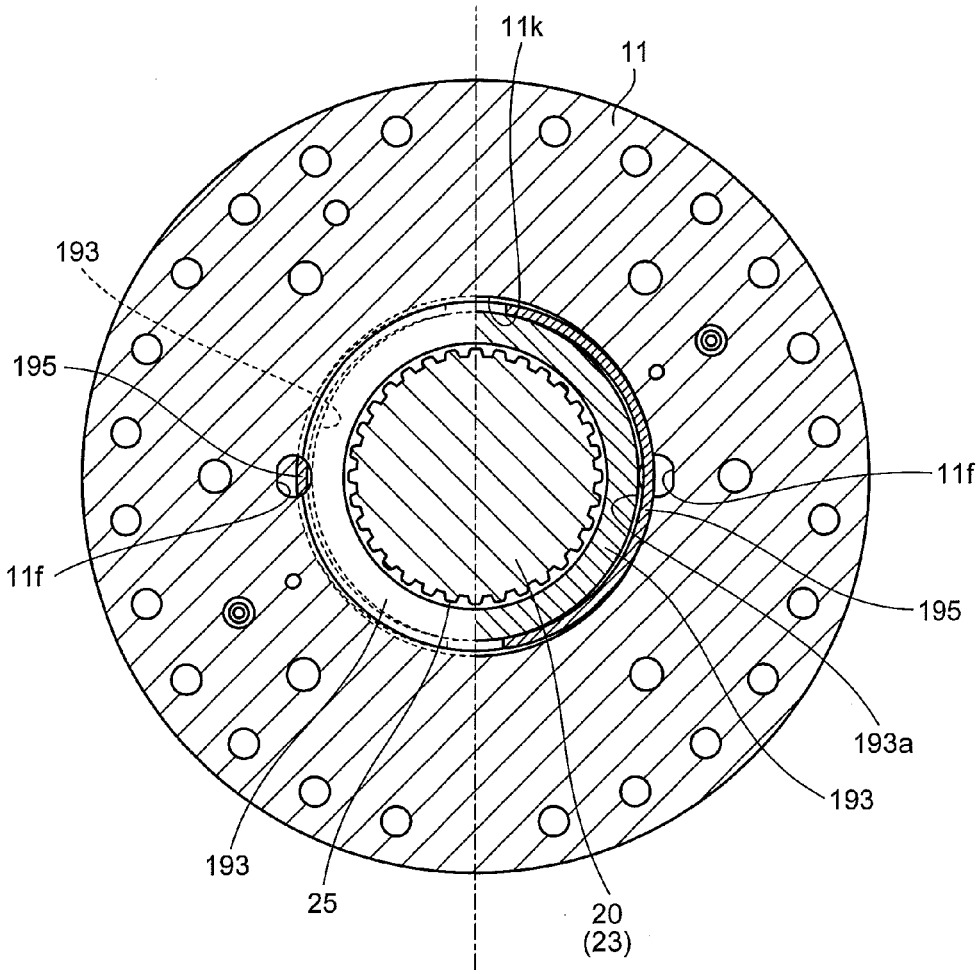
FIG. 9 is a cross-sectional view taken along line D-D in FIG. 7.

FIGS. 7 to 9 illustrate a bent axis type axial piston motor according to a second embodiment of the present invention. Like the bent axis type axial piston motor of the first embodiment, the illustrated bent axis type axial piston motor is used as a hydraulic drive motor in a construction machine vehicle such as a bulldozer and an excavator, but is different from the first embodiment in the configuration of restriction members disposed between a brake force receiving plate and a casing and a structure of disposing the restriction members between the brake force receiving plate and the casing.

That is, in the second embodiment, two elastic linear restriction members 195 are used. Each of the restriction members 195 has an approximate U-shape in no-load condition. Each of the restriction members 195 is shorter than ½ of the outer circumferential length of a brake force receiving plate (brake force receiving member) 193 and is narrower than the open area of each of connection passages 11*f* formed in a casing main body 11.

As illustrated in FIG. 8, an external engagement groove 193*a* is formed in the outer circumferential surface of the brake force receiving plate 193, and an internal engagement groove 11*k* is formed in the inner circumferential surface of a casing 10 at a position facing the external engagement groove 193*a*. The external engagement groove 193*a* and the internal engagement groove 11*k* are wide enough to accommodate the restriction members 195 and sufficiently deep so that the restriction members 195 can retract therein, and the external engagement groove 193*a* and the internal engagement groove 11*k* have a radius of curvature smaller than the radius of curvature of the restriction members 195 in no-load condition.

Figure 10:
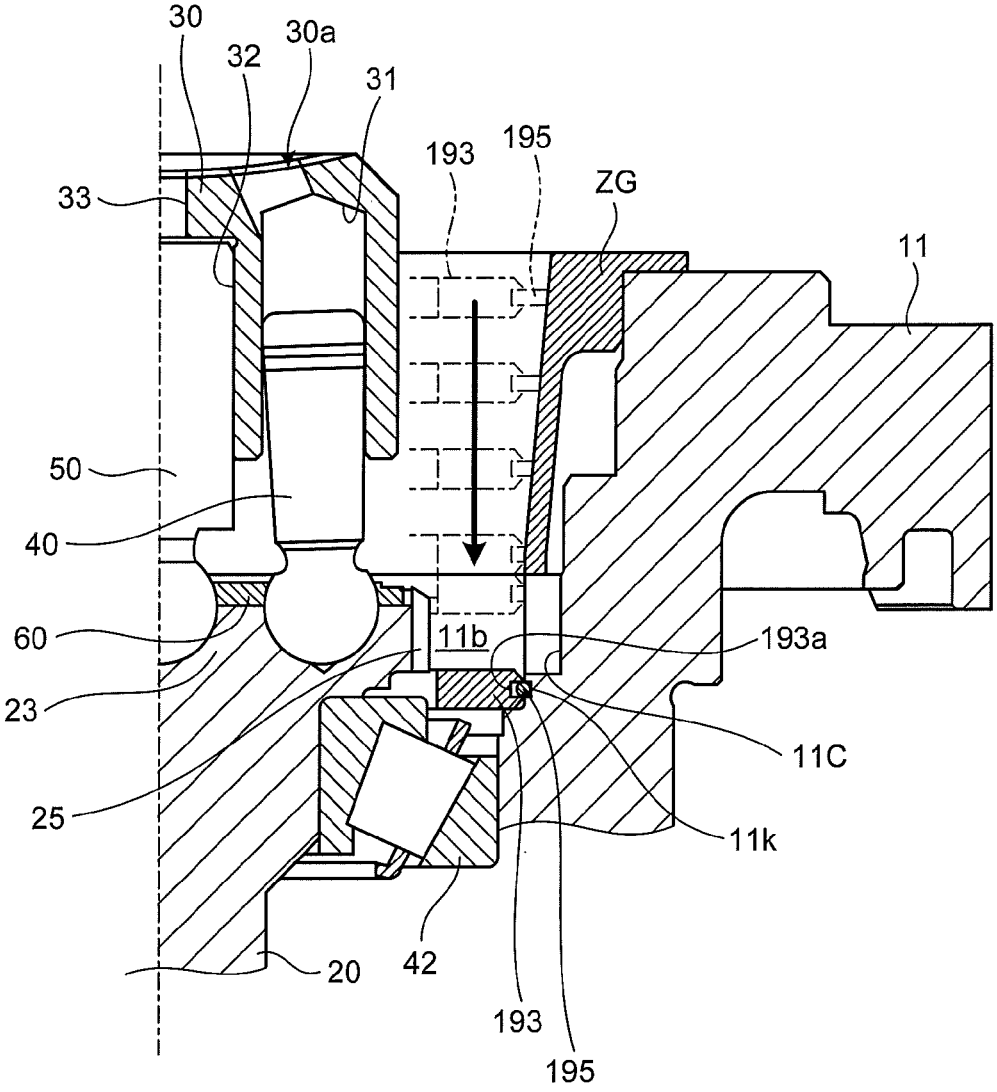
FIG. 10 is a main-part cross-sectional view for illustrating an exemplary operation for fitting a brake force receiving member to a casing in the bent axis type axial piston motor illustrated in FIG. 7.

In a process for disposing the restriction members 195 in the external engagement groove 193*a* of the brake force receiving plate 193 and the internal engagement groove 11*k* of the casing 10, first, as illustrated in FIG. 10, a taper-cylinder shaped jig ZG having a minimum inner radius equal to or smaller than the inner diameter of an accommodation space 11*b* is prepared, and the jig ZG is set on the casing main body 11 in a manner such that a minimum radius part of the jig ZG faces the position of the brake force receiving plate 193.

In this state, if the brake force receiving plate 193 in which the restriction members 195 are placed in the external engagement groove 193*a* is gradually inserted in the cylindrical jig ZG, at the time when the external engagement groove 193*a* reaches a position facing the internal engagement groove 11*k* of the casing 10, parts of the restriction members 195 move from the external engagement groove 193*a* to the internal engagement groove 11*k* of the casing 10 by the resilience of the restriction members 195. As a result, the brake force receiving plate 193 is restrained from moving along an axis 20C of a drive shaft 20 but allowed to rotate around the axis 20C of the drive shaft 20.

In the second embodiment, the same elements as those in the first embodiment are denoted by the same reference numerals, and detailed descriptions thereof are omitted.

In the above-described bent axis type axial piston motor, like in the first embodiment, since a second taper roller bearing 42 is disposed close to the accommodation space 11*b* of the casing 10, the drive shaft 20 can be smoothly rotated. In addition, since the restriction members 195 are disposed between the internal engagement groove 11*k* of the casing 10 and the external engagement groove 193*a* of the brake force receiving plate 193, the brake force receiving plate 193 disposed between the accommodation space 11*b* and a roller accommodation part 42*b* of the second taper roller bearing 42 can be restrained from moving along the axis 20C of the drive shaft 20. Therefore, although a jet flow of oil from the second taper roller bearing 42 collides with the brake force receiving plate 193 when the drive shaft 20 is rotated, gaps between friction plates 90 and separate plates 91 are not decreased, and thus rotational resistance between the friction plates 90 and the separate plates 91 is not increased. As a result, the drive shaft 20 can be smoothly rotated without lowering motor efficiency, and if necessary the drive shaft 20 can be braked.

In the second embodiment, since the restriction members 195 are narrower than the open areas of the connection passages 11*f*, the two connection passages 11*f* are not closed, and thus hydraulic pressure may not be undesirably increased in the casing 10.

REFERENCE SIGNS LIST

10 Casing
11*b* Accommodation space
11*j* Internal engagement groove
11*k* Internal engagement groove
20 Drive shaft
20C Axis
30 Cylinder block
30C Axis
40 Piston rod
42 Second taper roller bearing
42*a* Taper roller
42*b* Roller accommodation part
50 Center shaft
90 Friction plate
91 Separate plate
92 Braking piston
93 Brake force receiving plate
94 Braking spring
95 Restriction member
95*a* Long hole
96 Fixing screw member
193 Brake force receiving plate
193*a* External engagement groove
195 Restriction member

The invention claimed is:

1. A bent axis type axial piston motor comprising:

a drive shaft supported by a casing through a taper roller bearing disposed between the drive shaft and the casing, the drive shaft being supported in a manner such that an end part of the drive shaft is disposed in the casing and the drive shaft is rotatable on an axis thereof;

a cylinder block slidably connected to the end part of the drive shaft through a center shaft and a plurality of piston rods disposed around the center shaft, the cylinder block being disposed in the casing in a manner such that the cylinder block is rotatable around an axis of the center shaft;

an accommodation space formed in the casing at a position close to a roller accommodation part of the taper roller bearing and surrounding the end part of the drive shaft;

a plurality of first braking elements having an annular flat plate shape and disposed in the accommodation space in a manner such that the first braking elements are movable along the axis of the drive shaft but are restrained from rotating relative to the casing;

a plurality of second braking elements having an annular flat plate shape and disposed in the accommodation space in a manner such that the second braking elements are movable along the axis of the drive shaft but are restrained from rotating relative to the drive shaft, the second braking elements and the first braking elements being alternately arranged in the accommodation space;

a brake force receiving member having an annular shape and disposed in the accommodation space at a position facing the roller accommodation part of the taper roller bearing; and a braking member movably disposed at a position facing the brake force receiving member with the alternately arranged first and second braking elements disposed between the braking member and the brake force receiving member, so as to cause frictional forces between the first and second braking elements by pushing the first and second braking elements against the brake force receiving member, wherein when the drive shaft is rotated using the cylinder block by causing the piston rods to reciprocate, a pressing force applied by the braking member is removed to allow relative rotation between the first and second braking elements, and when the first and second braking elements are pushed against the brake force receiving member by the braking member, relative rotation between the first and second braking elements is restrained so as to brake the drive shaft, wherein a restriction member is disposed between the casing and the brake force receiving member to restrain the brake force receiving member from being moved relative to the casing along the axis of the drive shaft by a flow of oil from the taper roller bearing, wherein the restriction member has a plate shape and is attached to an end surface of the brake force receiving member in a state where an outer circumferential part of the restriction member protrudes from an outer circumferential part of the brake force receiving member, and an internal engagement groove is formed in the casing to receive an end part of the restriction member protruding from the outer circumferential part of the brake force receiving member.

2. The bent axis type axial piston motor according to claim 1, further comprising a plurality of restriction members, wherein the restriction members each include a plate shape and are arranged such that the restriction members protrude from a plurality of positions of the outer circumferential part of the brake force receiving member.

3. The bent axis type axial piston motor according to claim 2, wherein the restriction members have holes long in radial directions of the brake force receiving member and are attached to the end surface of the brake force receiving member by securing fixing screw members to the brake force receiving member through the long holes, and the restriction members are extendable or retractable from the outer circumferential part of the brake force receiving member by varying positions of the fixing screw members in the long holes.

4. The bent axis type axial piston motor according to claim 1, wherein an external engagement groove is formed in an outer circumferential part of the brake force receiving member, an internal engagement groove is formed in the casing at a position facing the external engagement groove of the brake force receiving member, and the restriction member is disposed between the external engagement groove of the brake force receiving member and the internal engagement groove of the casing.

5. The bent axis type axial piston motor according to claim 4, wherein the restriction member is an elastic linear member, and if the restriction member is elastically deformed by an external force, the restriction member is accommodated in the external engagement groove of the brake force receiving member, and if the external force is removed, at least a part of the restriction member protrudes outward from the external engagement groove of the brake force receiving member.

6. The bent axis type axial piston motor according to claim 1, wherein the brake force receiving member is allowed to rotate around the axis of the drive shaft.

* * * * *